US009101952B2

(12) United States Patent
McNulty et al.

(10) Patent No.: US 9,101,952 B2
(45) Date of Patent: Aug. 11, 2015

(54) MODULAR PUMP

(75) Inventors: John J. McNulty, Broadview Heights, OH (US); Nick E. Ciavarella, Seven Hills, OH (US); Todd A. Spiegelberg, North Ridgeville, OH (US); Robert L. Quinlan, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 52 days.

(21) Appl. No.: 13/484,988

(22) Filed: May 31, 2012

(65) Prior Publication Data

US 2012/0308405 A1 Dec. 6, 2012

Related U.S. Application Data

(60) Provisional application No. 61/493,802, filed on Jun. 6, 2011.

(51) Int. Cl.

| | |
|---|---|
| ***B67D 7/76*** | (2010.01) |
| ***B05B 11/00*** | (2006.01) |
| ***A47K 5/12*** | (2006.01) |
| ***A47K 5/14*** | (2006.01) |
| ***B05B 7/00*** | (2006.01) |

(52) U.S. Cl.

CPC ..... *B05B 11/3087* (2013.01); *A47K 5/1207* (2013.01); *A47K 5/14* (2013.01); *B05B 7/0025* (2013.01); *B05B 11/3026* (2013.01); *Y10T 29/49236* (2015.01)

(58) Field of Classification Search

CPC ..... B67D 7/76

USPC ..... 222/105, 190, 181.3, 182, 321.1–321.9, 222/325, 567, 570

See application file for complete search history.

(56) References Cited

U.S. PATENT DOCUMENTS

| | | | | | |
|---|---|---|---|---|---|
| 2,591,969 | A | * | 4/1952 | Sawchuk | 222/190 |
| 2,772,116 | A | * | 11/1956 | Dobkin | 222/190 |
| 4,230,242 | A | | 10/1980 | Meshberg | |
| 5,100,029 | A | | 3/1992 | Meshberg | |
| 5,110,052 | A | * | 5/1992 | Graf et al. | 239/333 |
| 5,289,952 | A | * | 3/1994 | Gueret | 222/190 |
| 5,445,288 | A | * | 8/1995 | Banks | 222/95 |
| 5,779,104 | A | * | 7/1998 | Reidel | 222/190 |
| 6,082,586 | A | * | 7/2000 | Banks | 222/95 |

(Continued)

OTHER PUBLICATIONS

WIPO International Search Report and Written Opinion dated Sep. 7, 2012 in related Application No. PCT/US2012/040458.

*Primary Examiner* — Paul R Durand
*Assistant Examiner* — Andrew P Bainbridge
(74) *Attorney, Agent, or Firm* — Calfee, Halter & Griswold LLP

(57) ABSTRACT

A modular liquid pump operable as a liquid pump when used by itself and as a foam pump when combined with a modular air pump is disclosed herein. In one embodiment, the modular liquid pump includes a housing for forming a least a portion of a liquid pump chamber; an inlet valve for allowing liquid into the liquid pump chamber; an outlet valve for allowing liquid out of the liquid pump chamber; and an attachment mechanism configured to secure the liquid pump housing to a modular air pump. The modular liquid pump operates alone to output a liquid or operates in combination with an air pump to output a foam. One embodiment includes a modular air pump configured to be secured to the modular liquid pump. In such a combination, the modular liquid pump and the air pump operate together to output a foam.

22 Claims, 9 Drawing Sheets

(56) References Cited

U.S. PATENT DOCUMENTS

| | | | | |
|---|---|---|---|---|
| 7,780,039 | B2 * | 8/2010 | Criswell et al. | 222/108 |
| 8,505,776 | B2 * | 8/2013 | Criswell et al. | 222/105 |
| 2007/0251953 | A1 | 11/2007 | Criswell et al. | |
| 2009/0188994 | A1 * | 7/2009 | Ray et al. | 239/343 |
| 2009/0200338 | A1 * | 8/2009 | Quinlan et al. | 222/190 |
| 2010/0089951 | A1 * | 4/2010 | Yates | 222/190 |

* cited by examiner

MODULAR PUMP

PRIORITY APPLICATIONS

The present application claims the benefit of, and priority to, U.S. Provisional Application Ser. No. 61/493,802, titled Modular Pump, filed on Jun. 6, 2011. U.S. Provisional Application Ser. No. 61/493,802 is incorporated herein in its entirety.

TECHNICAL FIELD

The present invention relates generally to pumps. More particularly, the present invention relates to modular pumps such as, for example, a modular liquid pump and a modular air pump that may be connected together to form a foam pump.

BACKGROUND OF THE INVENTION

Liquid dispensers, such as liquid soap and sanitizer dispensers, provide a user with a predetermined amount of liquid upon the actuation of the dispenser. It is known to dispense liquids, such as soaps, sanitizers, cleansers and disinfectants, from a dispenser housing that uses a removable and replaceable cartridge containing the liquid. The pump mechanisms employed with such dispensers are typically liquid pumps that dispense a predetermined quantity of the liquid upon movement of an actuator. Accordingly, if a company offers several different products that require different quantities of liquid to be dispensed, the company must make, stock and handle several different liquid pumps. In addition, it is sometimes desirable to dispense the liquids in the form of foam by, for example, interjecting air into the liquid creating a foamy mixture of liquid and air bubbles. Again, different products may require different volumes of liquid and air to be dispensed. Accordingly, if the company also sells several types of foam dispensing products, the company may also have to make, stock and handle several different foam pumps.

SUMMARY

A modular liquid pump operable as a liquid pump when used by itself and as a foam pump when combined with a modular air pump is disclosed herein. In one embodiment, the modular liquid pump includes a housing for forming a least a portion of a liquid pump chamber; an inlet valve for allowing liquid into the liquid pump chamber; an outlet valve for allowing liquid out of the liquid pump chamber; and an attachment mechanism configured to secure the liquid pump housing to a modular air pump. The modular liquid pump operates alone to output a liquid or operates in combination with an air pump to output a foam. One embodiment includes a modular air pump configured to be secured to the modular liquid pump. In such a combination, the modular liquid pump and the air pump operate together to output a foam.

BRIEF DESCRIPTION OF THE DRAWINGS

These and other features and advantages of the present invention will become better understood with regard to the following description and accompanying drawings where.

DETAILED DESCRIPTION

Figure 1A:
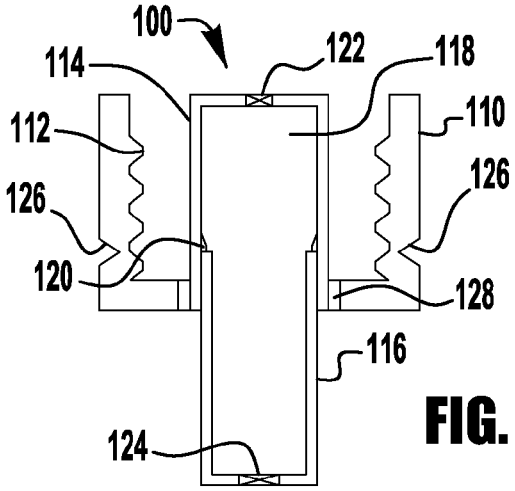
FIG. 1A illustrates a modular liquid pump in accordance with one embodiment of the present invention.

FIG. 1A illustrates a modular liquid pump 100. In one embodiment, modular liquid pump 100 includes a collar 110. Collar 110 has threads 112 for securing modular liquid pump 100 to a container (not shown) or liquid reservoir for holding a liquid, such as, for example, hand soap or sanitizer. Modular liquid pump 100 may be any type of liquid pump, such as, for example a piston pump. In one embodiment, liquid pump 100 includes a liquid chamber 118. Liquid chamber 118 is formed by cylinder 114 and piston 116. Piston 116 slides within cylinder 114 and includes wiper seal 120 to form a liquid tight seal between cylinder 114 and piston 116. Cylinder 114 includes a one-way inlet check valve 122, which allows liquid to enter the liquid chamber from a liquid reservoir (not shown). In addition, piston 116 includes a one-way outlet check valve 124 through which liquid is forced out of the liquid chamber 118.

During operation, liquid chamber 118 is compressed forcing inlet check valve 122 closed and causing liquid within chamber 118 to force open outlet check valve 124 and exit liquid chamber 118. When liquid chamber 118 is returned to an expanded position, outlet check valve 124 is forced closed and liquid is drawn into the liquid chamber 118 through inlet check valve 122. A biasing spring (not shown) may be used to return liquid chamber 118 to its expanded state. Modular liquid pump 100 is not limited to a piston pump and may be another type of pump, such as, for example, a bellows pump, a dome pump, a rotary pump or any other pump capable of moving a liquid from a liquid reservoir to an output.

In one embodiment, modular liquid pump 100 includes an output adjustment mechanism 128. Output adjustment mechanism 128 may be used to change the volume of liquid chamber 118 to vary the amount of liquid modular liquid pump 100 outputs with a single dispense. In one embodiment, output adjustment mechanism 128 may be used to limit the stroke of piston 116. One exemplary method of adjusting the stroke of piston 116 includes a collar 110 that has a threaded portion 128 and cylinder 114 that has a threaded mating portion. Rotating cylinder 114 in a first direction contracts liquid chamber 118 and limits the stroke of piston 116, and rotating cylinder 114 in the opposite direction expands liquid chamber 118 and increases the stroke of piston 106. Accordingly, modular liquid pump 100 may be manufactured, stocked on a shelf and used for multiple dispensing applications even if those applications call for different sized liquid doses.

In one embodiment, collar 110 includes a cylindrical recess 126 for receiving a mating projection 148 of modular air pump 130 (FIG. 1B) to convert modular liquid pump 100 into a foam pump. Other means for connecting modular air pump 130 to modular liquid pump 100 are contemplated herein, such as, for example, an adhesive for permanent connection; a threaded or bayonet connection so that the modular air pump 130 could be removed from the modular liquid pump and reused; a welded connection; a friction fit or taper lock.

In one embodiment, customers pay a deposit on each refill unit to encourage the customers to recycle the spent refill unit. During recycling, it may be advantageous to remove one or more parts of the modular foam pump, such as, for example, the modular air pump 130 that may be cleaned and reused in new refill units.

Modular air pump 130 includes a cylinder 132. As discussed above, cylinder 132 may include projections 148 for connecting to modular liquid pump 100. Cylinder 132 includes an opening 146 sized to fit over piston 116 (FIG. 1A) of modular liquid pump 100. A seal (not shown) may be included to form an airtight seal between liquid piston 116 and modular air pump 130. Suitable seals include, for example, an o-ring, an elastomeric washer, an integrally molded wiper seal or a lubricant, such as for example grease. Modular air pump 130 includes an air piston 136 that includes a seal 140. Seal 140 may be, for example, a wiper seal. During operation, air chamber 142 is compressed and air is forced out of air chamber 142 between a space located between air cylinder wall 138 and liquid piston 116 when the liquid pump 100 and air pump 130 are combined. A spring (not shown) may be used to bias modular air pump 130 to an expanded state.

In one embodiment, piston 136 includes an air inlet valve 144. Air inlet valve 144 allows air to enter air chamber 142 while air chamber 142 is expanding and prevents air from escaping air chamber 142 through inlet valve 144 while air chamber 142 is contracting. In one embodiment, piston 136 does not include an air inlet valve 144, but rather air is drawn into air chamber 142 through the air exit path between side walls 138 of air cylinder 136 and the outside wall of piston 116. Modular air pump 130 is not limited to a piston air pump and may be another type of pump, such as, for example, a bellows pump, a dome pump, a rotary pump or any other pump capable of compressing and causing air to be mixed with a liquid and dispensed as a foam through an output.

Just as the volume of modular liquid pump 100 may be adjusted, the volume of modular air pump 130 may also be adjusted. In one embodiment, the stroke of modular air pump 130 is limited by the stroke of modular liquid pump 100. Thus, changing the stroke of modular liquid pump 100 also changes the stroke and therefore the volume of modular air pump 130. In one embodiment, a cylindrical ring 149 (or multiple rings) may be used to limit the stroke of modular air pump 130. Cylindrical ring(s) 149 may be made of a resilient material, and the stroke of modular air pump 130 may be reduced by the thickness of one or more cylindrical ring(s) 149 inserted in air chamber 142.

Figure 1B:
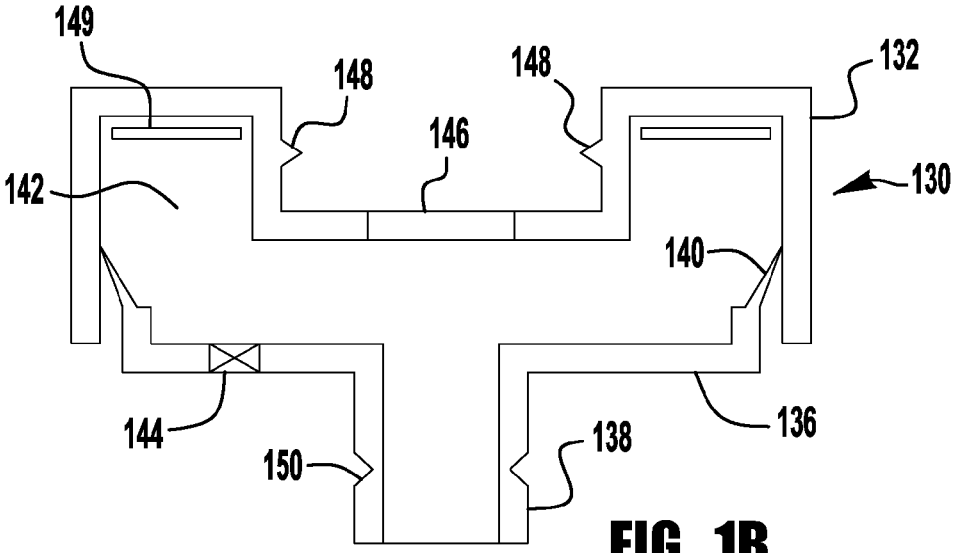
FIG. 1B illustrates a modular air pump for connecting to a modular liquid pump in accordance with one embodiment of the present invention.
Figure 1C:
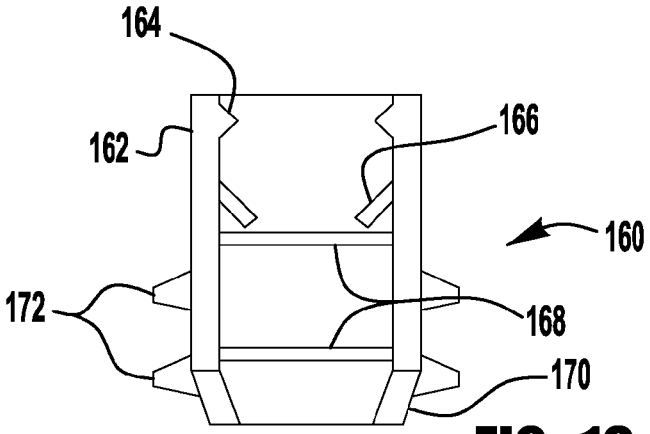
FIG. 1C illustrates a modular foam generator and nozzle for connecting to a modular air pump in accordance with one embodiment of the present invention.

FIG. 1C includes a modular foam generator 160. Modular foam generator 160 includes cylindrical side wall 162. Cylindrical sidewall 162 includes cylindrical projection 164. Cylindrical projection 164 is configured to snap-fit in cylindrical recess 150 of air piston 136 to connect modular foam generator 160 to modular air pump 130. In one embodiment, modular foam generator 160 includes air diverter 166 which directs compressed air during operation towards the center of modular foam generator 160 to mix with liquid that is being forced out of modular liquid pump 100. In one embodiment, modular foam generator 160 includes screens 168, nozzle 170 and ridges 172. An actuator (not shown) engages foam generator 160 between ridges 172 to compress the foam pump and dispense foam.

Figure 2:
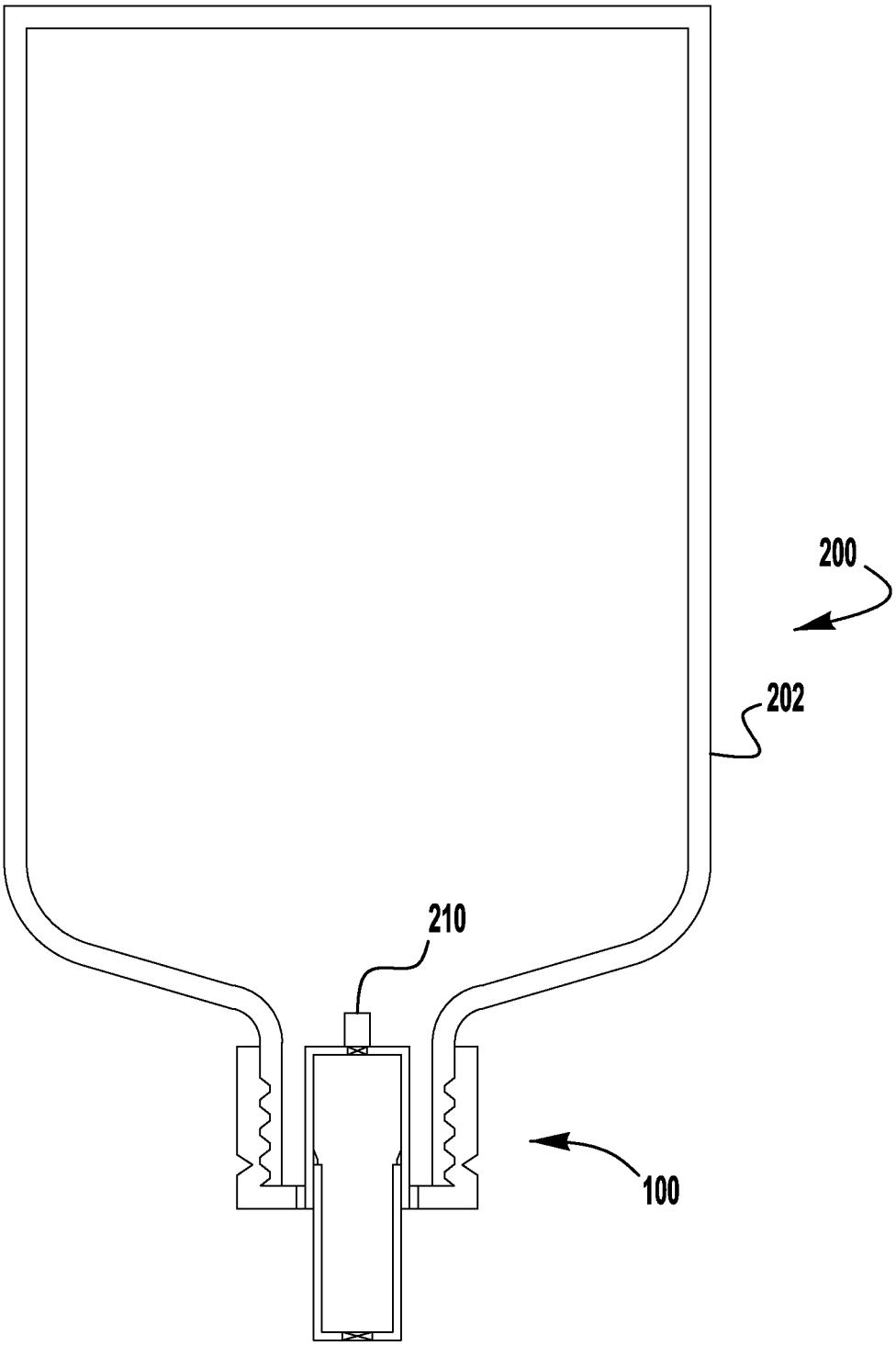
FIG. 2 illustrates the modular liquid pump of FIG. 1A connected to a liquid reservoir forming a refill unit for a liquid pump.

FIG. 2 illustrates a refill unit 200 for a liquid dispensing system (not shown). Refill unit 200 includes a liquid reservoir 202 and a modular liquid pump 100. In one embodiment, modular liquid pump 100 includes receptacle 210. Receptacle 210 is configured to receive a dip tube (not shown). By inserting a dip tube into receptacle 210, pump 100 and liquid reservoir 202 may be inverted and used in an upright dispensing system. In addition, various dispensing nozzles (not shown) may be secured to liquid pump 100 so that pump 100 may be used to dispense liquid in either an upright or inverted dispensing system.

Figure 3:
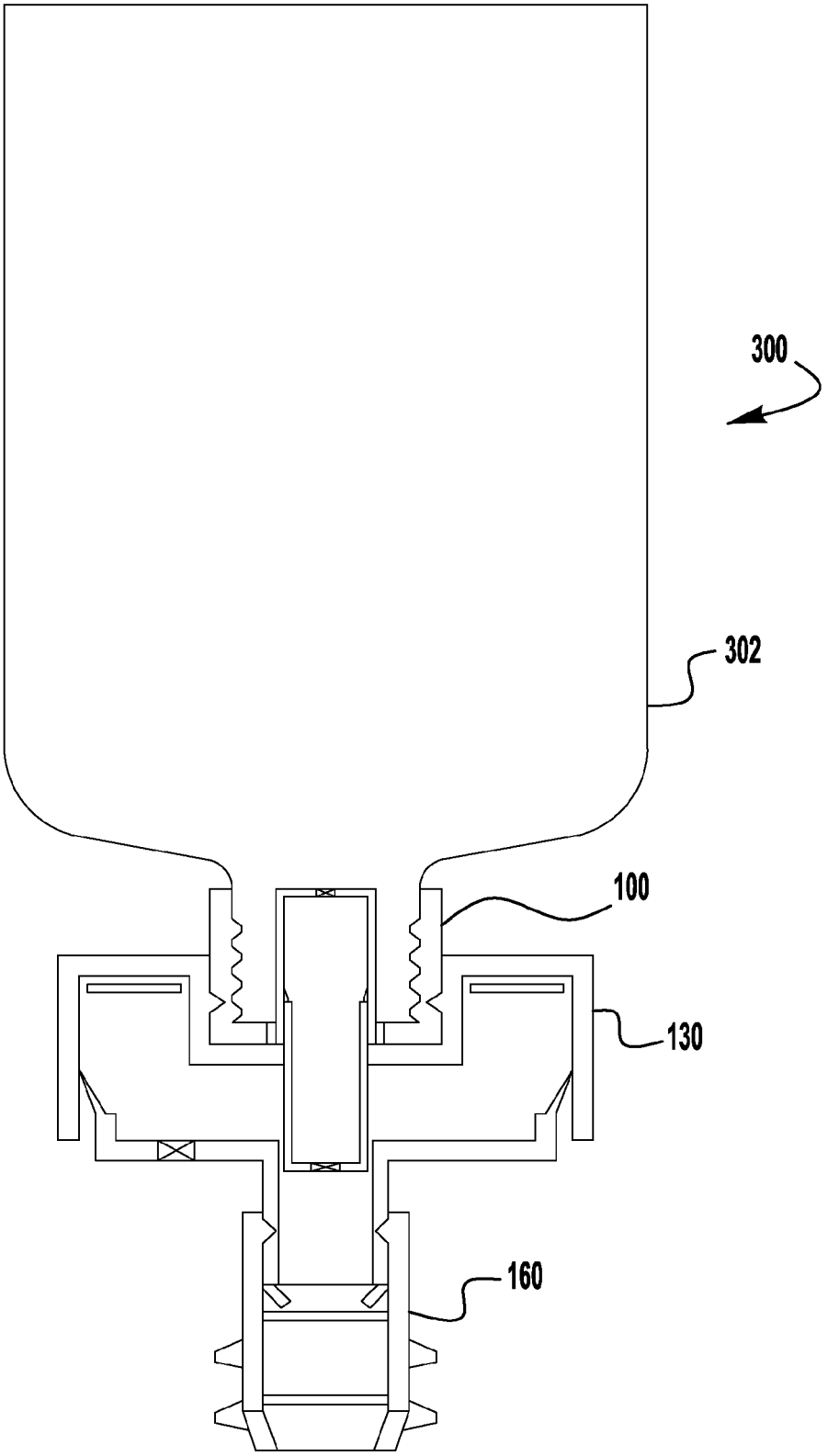
FIG. 3 illustrates the modular liquid pump of FIG. 1A, the modular air pump of FIG. 1B and the modular foam generator of FIG. 1C connected to one another and connected to a liquid reservoir to form a refill unit for a foam pump.

FIG. 3 illustrates a refill unit 300 for a foam dispenser (not shown). The refill units and modular pumps disclosed herein may be used in any type of dispenser, such as, for example, the dispenser shown and described in U.S. Pat. No. 7,066,357, which is incorporated herein by reference in its entirety. Refill unit 300 includes modular liquid pump 100 secured to liquid reservoir 302. Modular air pump 130 is snap-fit connected to liquid pump 100. In addition, modular foam generator 160 is snap-fit connected to modular air pump 130. In one embodiment, foam generator 160 is integrally made with modular air pump 130. Thus, modular liquid pump 100 may be used alone as a liquid pump (FIG. 2) or in combination with a modular air pump 130 as a foam pump (FIG. 3).

Figure 4A:
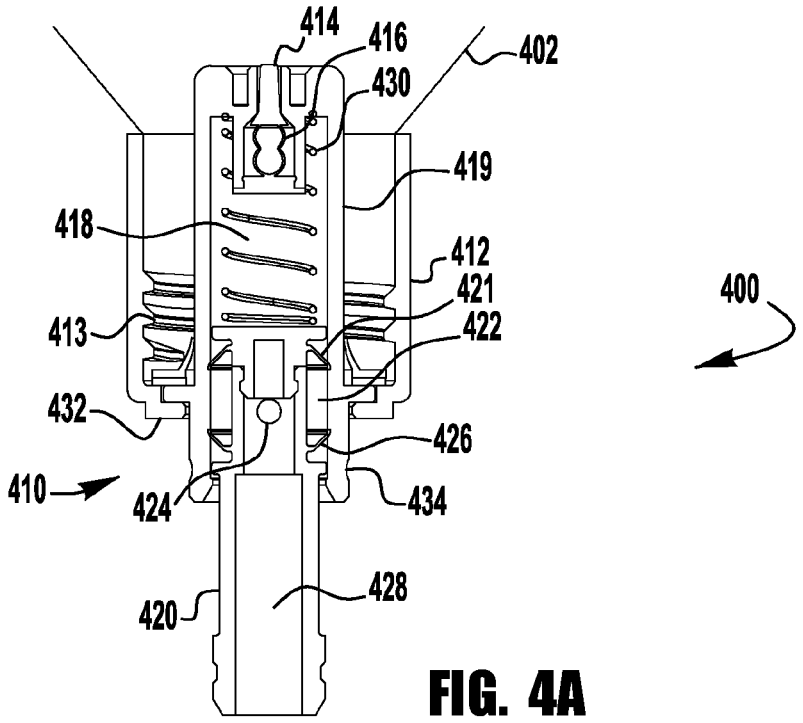
FIG. 4A illustrates another modular liquid pump in accordance with one embodiment of the present invention.

FIG. 4A illustrates another modular pump 400. Modular liquid pump 400 includes a collar 412 having threads 413 for connecting modular pump 400 to liquid reservoir 402. Modular liquid pump 400 includes a liquid chamber 418 formed by cylinder 419 and piston 420. Liquid enters the liquid chamber 418 through a one-way liquid inlet valve 414 and a biasing member 416. Liquid exits liquid chamber 418 through a one-way liquid outlet valve 421. Wiper seal 426 prevents liquid from escaping around piston 420. In addition, modular liquid pump 400 includes a biasing spring 430 to bias liquid chamber 418 to its largest volume. Modular liquid pump 400 also includes a cylindrical seat 432 and a cylindrical recess 434 for connection to a modular air pump.

Figure 4B:
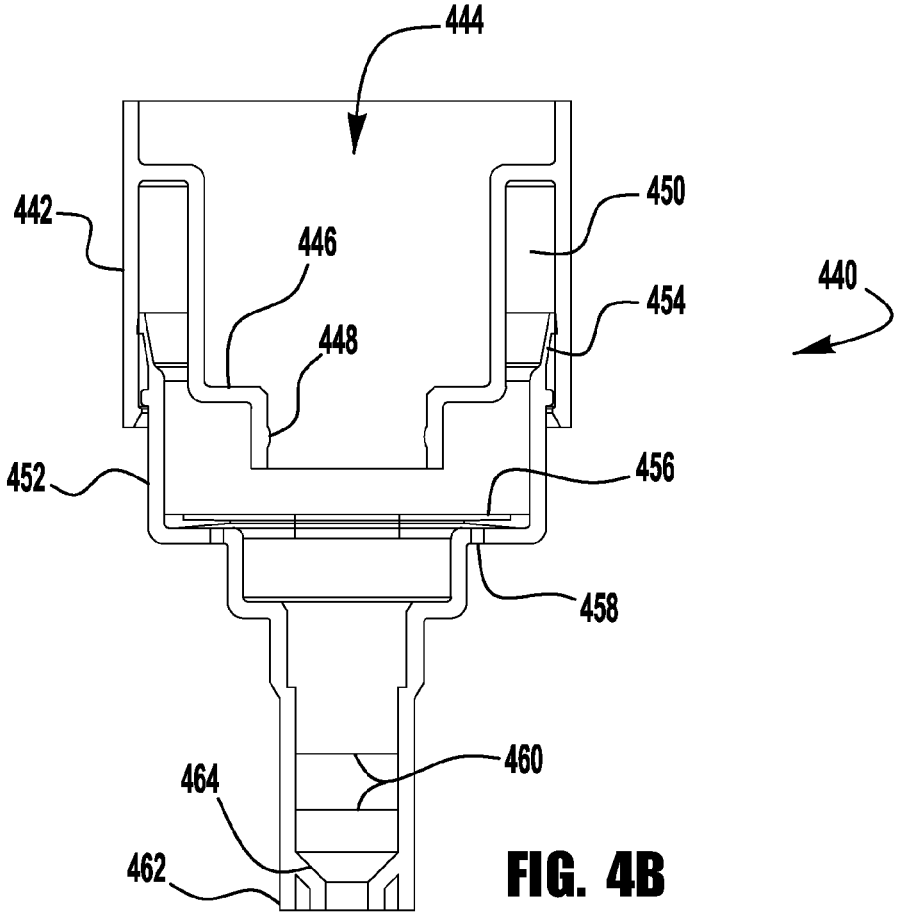
FIG. 4B illustrates a modular air pump for connecting to a modular liquid pump in accordance with one embodiment of the present invention.

When modular liquid pump 400 is used as a foam pump, seat 432 rests up against a mating ledge 446 (FIG. 4B) on modular air pump 440. A sealing member (not shown) may be positioned between seat 432 and ledge 446 to prevent air from escaping past seat 432 and ledge 446 during operation. Modular air pump 440 includes an air chamber 450 formed by a cylindrical shell 442 and air piston 452. Cylindrical shell 442 includes a recessed portion 444. Recessed portion 444 fits over modular liquid pump 400 and cylindrical projection 448 snaps into cylindrical recess 434. Modular liquid pump 400 and modular air pump 440 may be connected to one another by other means, such as, for example, a threaded connection, a pressure fit, an adhesive, held together by the weight of the refill unit or other suitable means. Modular air pump 440 also includes an air inlet opening 458 and a one-way valve 456. In one embodiment, one-way valve 456 is formed of a cylindrical disk made up of a thermoplastic material. Optionally, modular air pump 440 includes a foam generator, such as, for example screens 460 and an outlet nozzle 462. In one embodiment, outlet nozzle 462 tapers at ledge 464 to increase the velocity of the foam as it exits the nozzle.

Figure 4C:
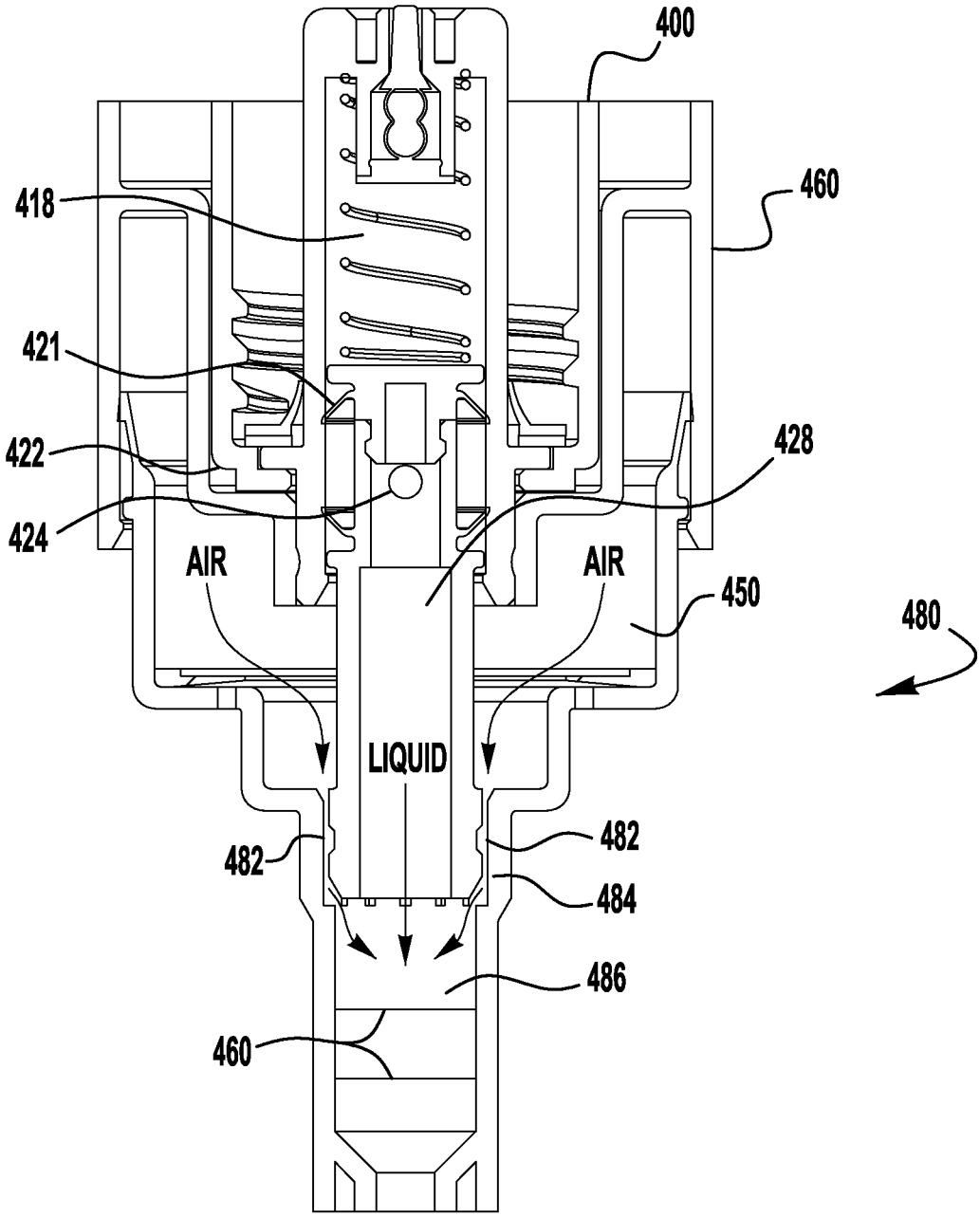
FIG. 4C illustrates the modular liquid pump of FIG. 4A connected to the modular air pump of FIG. 4B to form a foam pump in accordance with one embodiment of the present invention.

FIG. 4C illustrates modular liquid pump 400 connected to modular air pump 460 to form a foam pump 480. During operation, air chamber 450 and liquid chamber 418 are compressed which forces liquid to flow out of liquid chamber 418 past outlet valve 421 into annular chamber 422, through opening 424 and into liquid outlet 428. Simultaneously, air is compressed in air chamber 450 and flows through channels 482 between liquid piston 420 and sidewall 484 of air cylinder 452. The liquid and compressed air mix in mixing chamber 486 and the mixture is forced through screens 460 and out of nozzle 462 in the form of a foam. Upon release of the force to actuate the pump, chambers 418, 450 expand and are recharged with liquid and air respectively.

Figure 5:
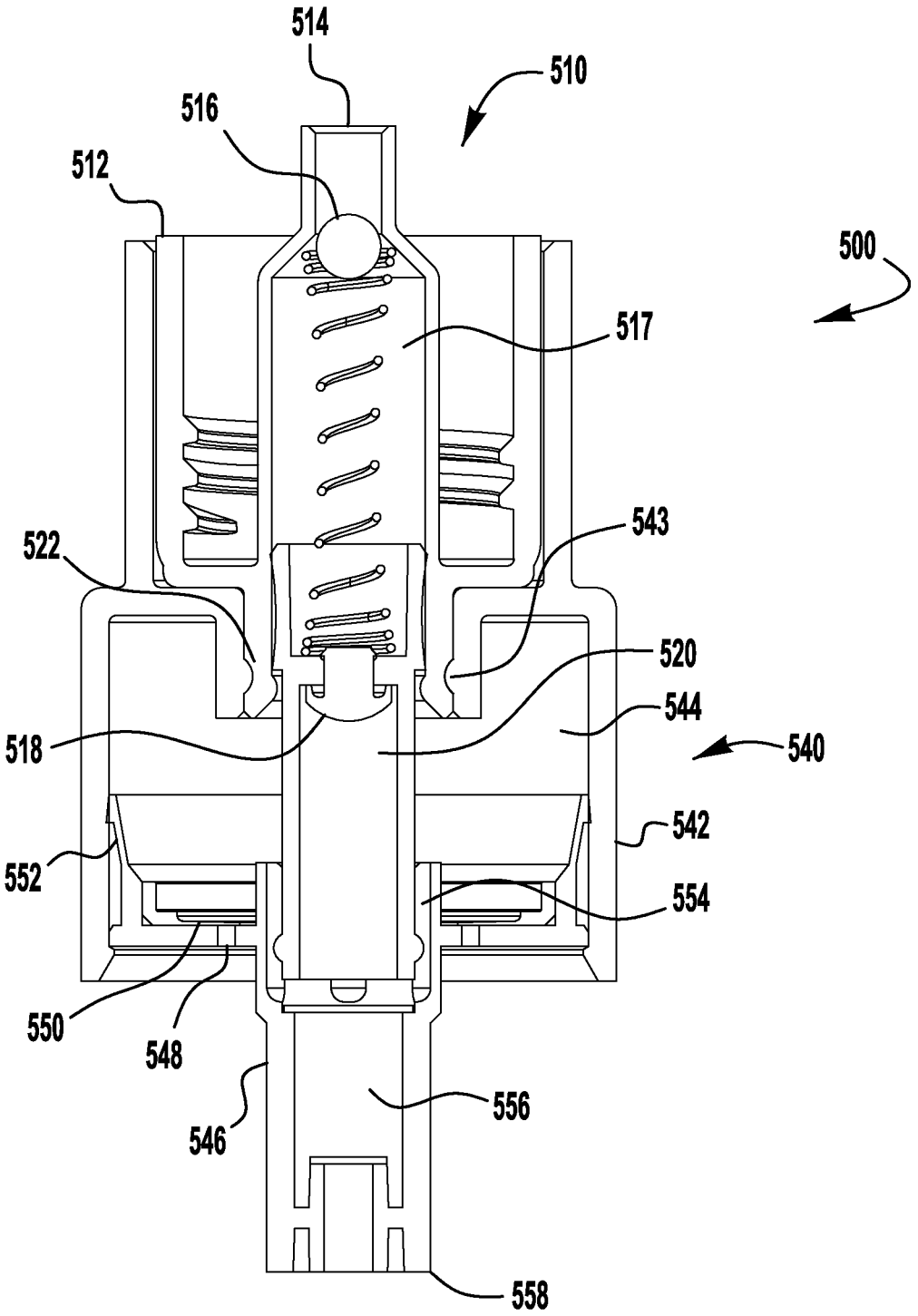
FIG. 5 illustrates a modular liquid pump combined with a modular air pump to form a foam pump made of modular components in accordance with one embodiment of the present invention.

FIG. 5 illustrates yet another embodiment of a foam pump 500 that is made up of a modular liquid pump 510 and a modular air pump 540. Modular liquid pump 510 may be used alone as a liquid pump, or may be used with modular air pump 540 to form a foam pump. Modular liquid pump 510 is similar to previously described modular liquid pumps. Modular liquid pump 510 includes a collar 512 having a cylindrical recess 522 for securing modular liquid pump 510 to modular air pump 540. Modular liquid pump 510 includes a liquid pump chamber 517 having a one-way inlet check valve in the form of a ball valve 516 located proximate liquid inlet 514 and a one-way outlet check valve in the form of a mushroom valve 518 located at the outlet of pump chamber 517.

Modular air pump 540 is similar to the previously described modular air pumps and has a cylindrical housing 542 that includes a cylindrical projection 543 for creating a snap-fit connection with modular liquid pump 510. Modular air pump 540 includes an air chamber 544, air piston 546, air inlet opening 548, one-way air inlet valve 550, a wiper seal 552, mixing chamber 556 and nozzle 558.

Figure 6:
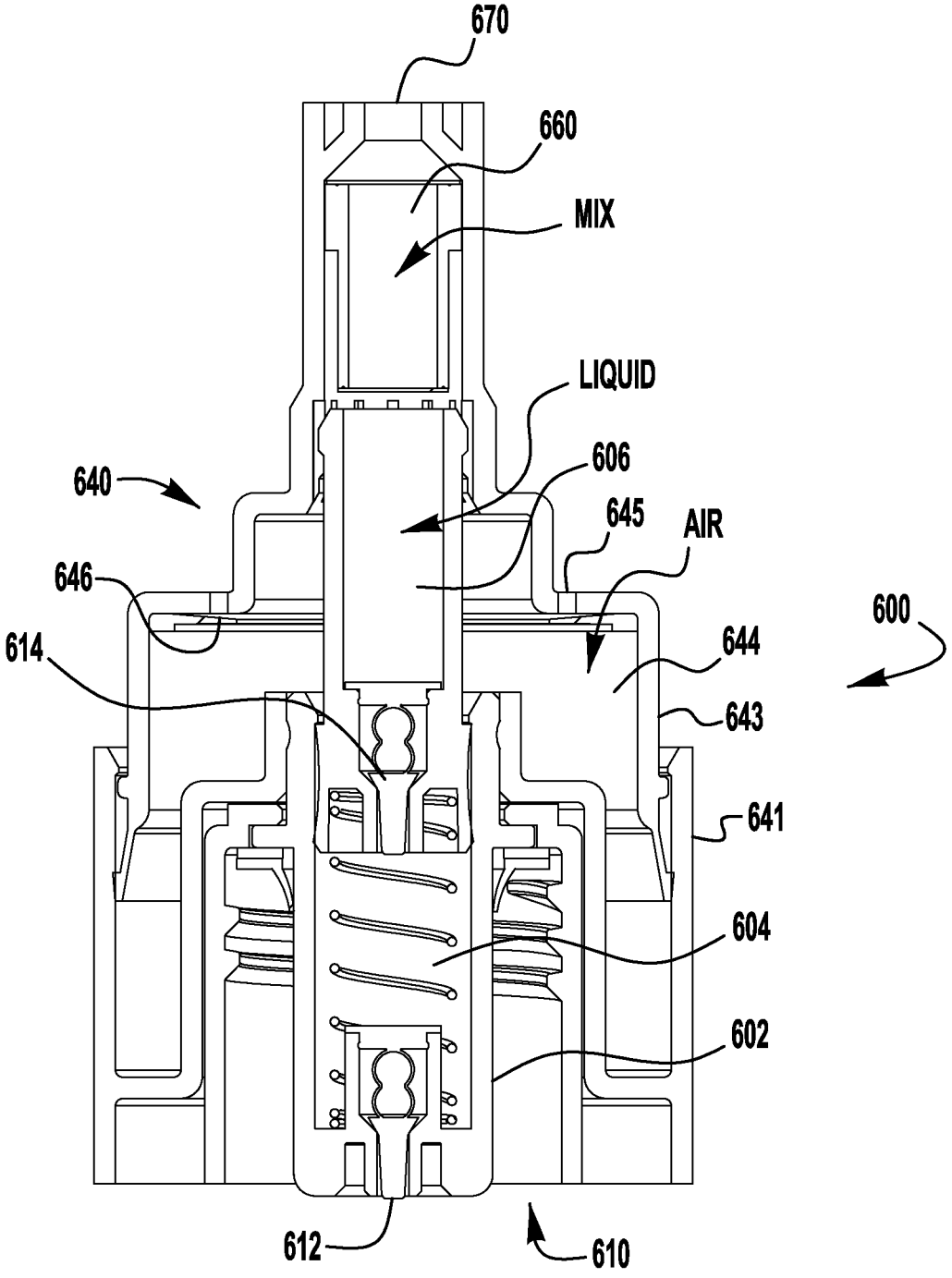
FIG. 6 illustrates another modular liquid pump combined with a modular air pump to form a foam pump made of modular components in accordance with one embodiment of the present invention.

Similarly, FIG. 6 illustrates another exemplary embodiment of a foam pump 600 made up of a modular liquid pump 610 and a modular air pump 640. Again, liquid pump 610 may be used with or without air pump 640. FIG. 6 illustrates that the modular pumps may be used in the inverted or upright position. The liquid pump portion includes a one-way inlet valve 612, a compressible liquid chamber 604, a one-way liquid outlet valve 614 and liquid nozzle 606. Modular air pump 640 includes a housing 641, an air piston 643, an air inlet 645 with an one-way air inlet valve 646, a compressible air chamber 644, a mixing chamber 660 that may include one or more porous members (not shown) to enhance or create foam and an outlet nozzle 670. The foam pump 600 functions in substantially the same way as the other pumps described herein.

Figure 7A:
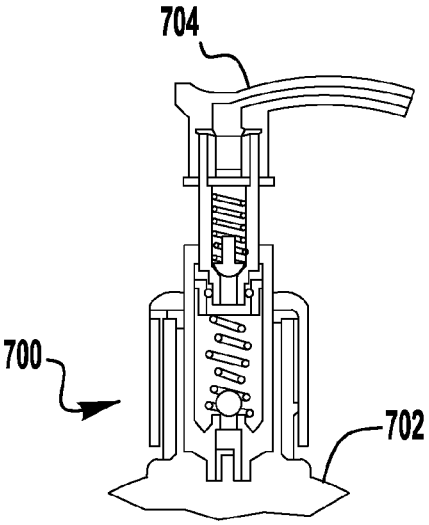
FIGS. 7A-7C illustrate embodiments of upright modular pumps in accordance with embodiments of the present invention.
Figure 7B:
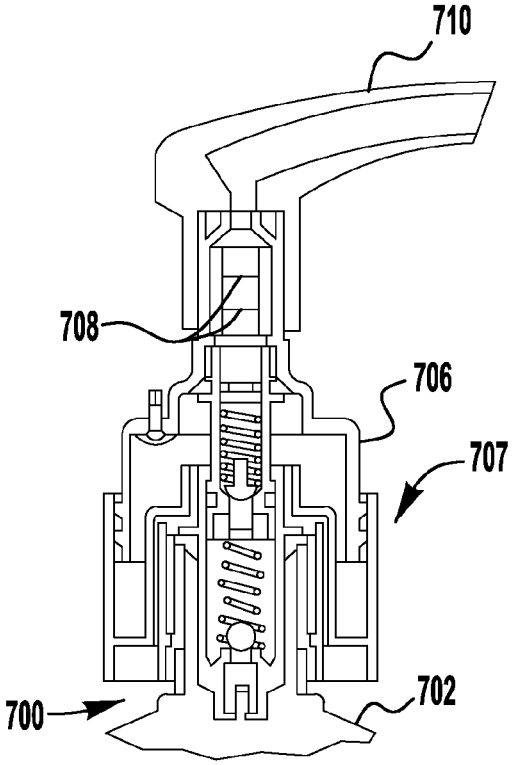
Figure 7C:
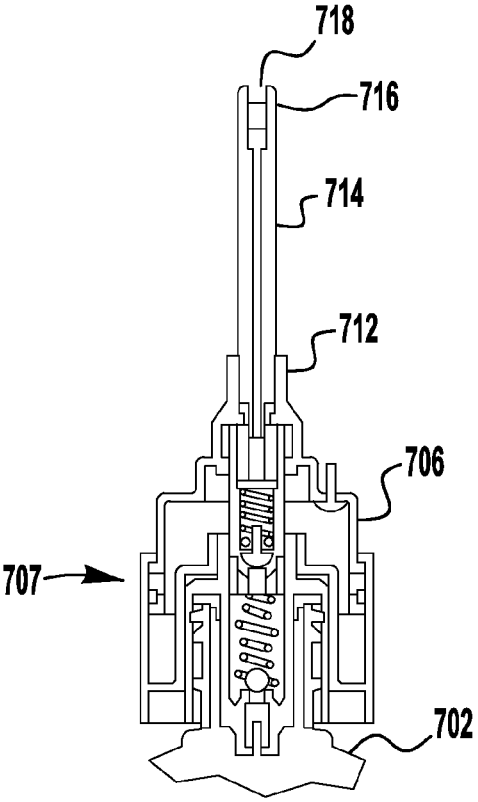

FIG. 7A illustrates a modular liquid pump 700 secured to a liquid container, or liquid reservoir 702. Modular liquid pump 700 is configured to operate by itself as a liquid pump or in combination with an air pump as a foam pump. Modular liquid pump 700 includes the typical components in a pump, similar to those described in more detail herein. In FIG. 7A, modular liquid pump 700 is shown configured to operate as a liquid pump and has a liquid dispensing nozzle 704. FIG. 7B illustrates modular liquid pump 700 combined with modular air pump 706 to form modular foam pump 707. Modular air pump 706 includes the typical components for a piston air pump as described herein in detail. In one embodiment, modular foam pump 707 has a foam generator 708 located proximate modular foam pump 707 and a foam dispensing nozzle 710. In addition, FIG. 7C illustrates a modular foam pump 707 made up of modular liquid pump 700 and modular air pump 706. A standard modular air pump may be configured to receive either a tube (FIG. 7C) or nozzle (FIG. 7B). In the exemplary embodiments of FIG. 7C, modular foam pump 707 includes connector 712 that receives a coaxial tube 714 and a modular foam generator 716 located at the end of coaxial tube 714. During operation, liquid is pumped through the inner tube of the coaxial tube 714 and air is pumped through the outer tube. The liquid and air are mixed together at the distal end and forced through foam generator 716, also located at the distal end of the coaxial tube 714, and the mixture is dispensed at outlet 718 in the form of a foam. Accordingly, modular pump 700 may be used as an upright liquid pump shown in FIG. 7A, as an upright modular foam pump 707 with a local dispensing nozzle 710 as shown in FIG. 7B and with a remote dispensing outlet 718 as shown in FIG. 7C, for use in, for example, an under-counter mounted foam dispenser.

Figure 8:
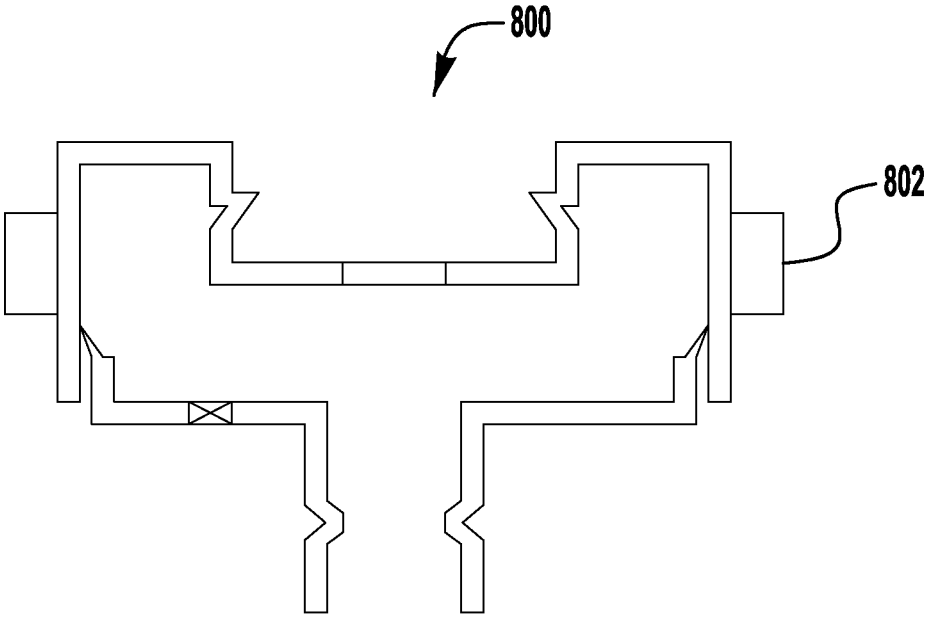
FIG. 8 illustrates an embodiment of a modular air pump having a keying system in accordance with one embodiment of the present invention.

FIG. 8 illustrates a modular air pump 800, similar to modular air pump 130 illustrated in FIG. 1B. Modular air pump 800 includes a key 802. In one embodiment, key 802 is integrally molded with modular air pump 800. Key 802 may be any unique configuration or pattern of projections that are configured to mate with mating configurations or recesses in a dispenser housing. In one embodiment, key 802 may be recesses (not shown) molded into modular air pump 800 that mate with mating projections in a dispenser housing. Optionally, key 802 may be a combination of recesses and projections that mate with mating projections or recesses in a dispenser. "Keying" refill units allows a manufacturer to provide special "keyed" dispensers to customers that can only be refilled by like keyed refill units. Thus, a manufacturer need only stock a single type of modular liquid pump (not shown) and attach one of several differently keyed modular air pumps 800 to the modular liquid pump depending on the particular customer that will be receiving the refill unit.

While the present invention has been illustrated by the description of embodiments thereof and, while the embodiments have been described in considerable detail, it is not the intention of the applicants to restrict or in any way limit the scope of the appended claims to such detail. Additional advantages and modifications will readily appear to those skilled in the art. For example, various different types of modular foam generators may be combined with the modular foam pumps. In addition, different components of the liquid pump or the air pump may also be modularized for combination with one another to form the modular liquid pump or modular foam pump. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A modular liquid pump operable as a liquid pump when used by itself and as a foam pump when combined with a modular air pump, the modular liquid pump comprising:

a liquid pump housing for forming at least a portion of a liquid pump chamber;

an inlet valve for allowing liquid into the liquid pump chamber;

a liquid piston movable within the liquid pump housing;

an outlet valve for allowing liquid out of the liquid pump chamber; and an attachment mechanism configured to secure the liquid pump housing to a modular air pump;

wherein the modular liquid pump operates alone to output a liquid through a first outlet and selectively operates in combination with the modular air pump to output a foam through a second outlet; and wherein when the liquid pump housing is secured to the modular air pump, the modular air pump and the liquid piston are coaxial and the liquid piston extends at least partially through the center of the modular air pump.

2. The modular liquid pump of claim 1 further comprising:

a modular air pump configured to be secured to the modular liquid pump, wherein the combination of the modular liquid pump and the air pump operate together to output a foam.

3. The modular liquid pump of claim 2 wherein the attachment mechanism comprises at least one of a snap-fit connection, a welded connection, an adhesive, a friction fit, a taper lock, a threaded connection or a bayonet connection.

4. The modular liquid pump of claim 2 further comprising a modular foam generator secured to the modular air pump, wherein the second outlet is downstream of the foam generator.

5. The modular liquid pump of claim 1 further comprising a liquid output adjustment mechanism to adjust the output volume of the modular liquid pump.

6. The modular liquid pump of claim 2 further comprising an air output adjustment mechanism to adjust the output volume of the modular air pump.

7. The modular liquid pump of claim 1 wherein the liquid pump is a liquid piston pump.

8. The modular liquid pump of claim 2 wherein the air pump is an air piston pump.

9. A modular air pump for connecting to a modular liquid pump to form a foam pump comprising:

a housing forming at least a portion of an air chamber;

the housing having a securing mechanism for securing the housing to a modular liquid pump to form the foam pump when combined with the modular liquid pump that has a liquid outlet;

wherein when combined with the modular liquid pump, a liquid piston of the modular liquid pump extends through at least a portion of the modular air pump chamber and the modular air pump chamber and the piston are coaxial with respect to one another, and liquid flows out of the liquid outlet and mixes with air flowing out of the modular air pump below the liquid outlet.

10. The modular air pump of claim 9 wherein the securing mechanism comprises at least one of a snap-fit connection, a welded connection, an adhesive, a friction fit, a taper lock, a threaded connection or a bayonet connection.

11. The modular air pump of claim 9 wherein at least a portion of the air chamber is formed by the liquid pump after the modular air pump is secured to the liquid pump.

12. The modular air pump of claim 11 further comprising an air piston moveable at least partially within the housing.

13. The modular air pump of claim 11 further comprising an air inlet opening and an air inlet valve.

14. The modular air pump of claim 11 wherein the securing mechanism is at least part of a snap-fit mechanism.

15. The modular air pump of claim 11 wherein the securing mechanism is a mechanical connection.

16. The modular air pump of claim 11 further comprising an air volume adjustment mechanism to vary the volume output of the modular air pump.

17. A method for assembling a foam pump comprising:

obtaining a modular air pump configured to attach to the modular liquid pump; obtaining a modular liquid pump that has a piston and a liquid outlet that selectively operates as a liquid pump and that has an attachment mechanism for attaching the liquid pump to the modular air pump;

and connecting the modular air pump to the modular liquid pump to create a foam pump;

wherein when connected together, the liquid piston extends at least partially through the air chamber and wherein the modular air pump and the piston are coaxial oriented; and wherein liquid flows out of the liquid outlet prior to mixing with air flowing out of the modular air pump.

18. The method of claim 17 further comprising obtaining a modular foam generator and attaching the modular foam generator to the foam pump.

19. The method of claim 17 further comprising adjusting the volume output of the modular liquid pump.

20. The method of claim 17 further comprising adjusting the volume output of the modular air pump.

21. The method of claim 17 wherein obtaining a modular liquid pump comprises obtaining a modular liquid piston pump.

22. The method of claim 17 wherein obtaining a modular air pump comprises obtaining a modular air piston pump.

* * * * *